US007725249B2

(12) United States Patent
Kickbusch et al.

(10) Patent No.: US 7,725,249 B2
(45) Date of Patent: May 25, 2010

(54) METHOD AND APPARATUS FOR CONGESTION MANAGEMENT

(75) Inventors: Joel Kickbusch, Rockledge, FL (US); Randall Markley, Melbourne, FL (US); Mitchell Scott Wills, Melbourne, FL (US); Joseph Wesley Philp, Indialantic, FL (US)

(73) Assignee: General Electric Company, Schenectady, NY (US)

( * ) Notice: Subject to any disclaimer, the term of this patent is extended or adjusted under 35 U.S.C. 154(b) by 1151 days.

(21) Appl. No.: 11/342,874

(22) Filed: Jan. 31, 2006

(65) Prior Publication Data

US 2006/0212189 A1 Sep. 21, 2006

Related U.S. Application Data

(63) Continuation-in-part of application No. 10/785,059, filed on Feb. 25, 2004, now abandoned.

(60) Provisional application No. 60/449,849, filed on Feb. 27, 2003.

(51) Int. Cl.
*G06G 7/76* (2006.01)
*G05D 3/00* (2006.01)
*G06F 19/00* (2006.01)

(52) U.S. Cl. ..... 701/117; 701/19; 701/210; 340/990

(58) Field of Classification Search ..... 701/19, 701/117, 118, 20, 201, 210, 1; 246/2 R, 246/2 F, 2 S; 404/1; 104/307; 705/13; 340/990
See application file for complete search history.

(56) References Cited

U.S. PATENT DOCUMENTS

| | | | |
|---|---|---|---|
| 3,575,594 | A | 4/1971 | Elcan |
| 3,734,433 | A | 5/1973 | Metzner |
| 3,794,834 | A | 2/1974 | Auer, Jr. et al. |
| 3,839,964 | A | 10/1974 | Gayot |
| 3,895,584 | A | 7/1975 | Paddison |

(Continued)

FOREIGN PATENT DOCUMENTS

CA 2057039 12/1990

(Continued)

OTHER PUBLICATIONS

Crone, et al., "Distributed Intelligent Network Management for the SDI Ground Network," IEEE, 1991, pp. 722-726, MILCOM '91.

(Continued)

*Primary Examiner*—Thomas G Black
*Assistant Examiner*—Christine M Behncke
(74) *Attorney, Agent, or Firm*—Duane Morris LLP

(57) ABSTRACT

A scheduling system and method for moving plural objects through a multipath system described as a freight railway scheduling system. The scheduling system utilizes a cost reactive resource scheduler to minimize resource exception while at the same time minimizing the global costs associated with the solution. The achievable movement plan can be used to assist in the control of, or to automatically control, the movement of trains through the system. Deadlock is avoided by controlling the entry of trains into congested areas, and may be automatically implemented by the use of traffic flow analysis algorithms.

11 Claims, 2 Drawing Sheets

U.S. PATENT DOCUMENTS

| | | | | |
|---|---|---|---|---|
| 3,944,986 | A | 3/1976 | Staples | |
| 4,099,707 | A | 7/1978 | Anderson | |
| 4,122,523 | A | 10/1978 | Morse et al. | |
| 4,361,300 | A | 11/1982 | Rush | |
| 4,361,301 | A | 11/1982 | Rush | |
| 4,610,206 | A | 9/1986 | Kubala et al. | |
| 4,669,047 | A | 5/1987 | Chucta | |
| 4,791,871 | A | 12/1988 | Mowll | |
| 4,843,575 | A | 6/1989 | Crane | |
| 4,883,245 | A | 11/1989 | Erickson, Jr. | |
| 4,926,343 | A | 5/1990 | Tsuruta et al. | |
| 4,937,743 | A | 6/1990 | Rassman et al. | |
| 5,038,290 | A | 8/1991 | Minami | |
| 5,063,506 | A | 11/1991 | Brockwell et al. | |
| 5,177,684 | A * | 1/1993 | Harker et al. | 701/117 |
| 5,222,192 | A | 6/1993 | Shafer | |
| 5,229,948 | A | 7/1993 | Wei et al. | |
| 5,237,497 | A | 8/1993 | Sitarski | |
| 5,265,006 | A | 11/1993 | Asthana et al. | |
| 5,289,563 | A | 2/1994 | Nomoto et al. | |
| 5,311,438 | A | 5/1994 | Sellers et al. | |
| 5,331,545 | A | 7/1994 | Yajima et al. | |
| 5,332,180 | A | 7/1994 | Peterson et al. | |
| 5,335,180 | A | 8/1994 | Takahashi et al. | |
| 5,365,516 | A | 11/1994 | Jandrell | |
| 5,390,880 | A | 2/1995 | Fukawa et al. | |
| 5,420,883 | A | 5/1995 | Swensen et al. | |
| 5,437,422 | A | 8/1995 | Newman | |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,623,413 | A | 4/1997 | Matheson et al. | |
| 5,745,735 | A | 4/1998 | Cohn et al. | |
| 5,794,172 | A | 8/1998 | Matheson et al. | |
| 5,823,481 | A | 10/1998 | Gottschlich | |
| 5,825,660 | A | 10/1998 | Cagan et al. | |
| 5,828,979 | A | 10/1998 | Polivka et al. | |
| 5,850,617 | A | 12/1998 | Libby | |
| 5,928,294 | A * | 7/1999 | Zelinkovsky | 701/24 |
| 6,032,905 | A | 3/2000 | Haynie | |
| 6,115,700 | A | 9/2000 | Ferkinhoff et al. | |
| 6,125,311 | A | 9/2000 | Lo | |
| 6,144,901 | A | 11/2000 | Nickles et al. | |
| 6,154,735 | A | 11/2000 | Crone | |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,459,964 | B1 * | 10/2002 | Vu et al. | 701/19 |
| 6,459,965 | B1 | 10/2002 | Polivka et al. | |
| 6,587,764 | B2 | 7/2003 | Nickles et al. | |
| 6,637,703 | B2 | 10/2003 | Matheson et al. | |
| 6,654,682 | B2 | 11/2003 | Kane et al. | |
| 6,766,228 | B2 | 7/2004 | Chirescu | |
| 6,789,005 | B2 | 9/2004 | Hawthorne | |
| 6,799,097 | B2 | 9/2004 | Antelo et al. | |
| 6,799,100 | B2 | 9/2004 | Burns et al. | |
| 6,823,256 | B1 * | 11/2004 | Burt | 701/200 |
| 6,827,315 | B2 * | 12/2004 | Fierz et al. | 246/20 |
| 6,853,889 | B2 | 2/2005 | Cole | |
| 6,856,865 | B2 | 2/2005 | Hawthorne | |
| 6,873,962 | B1 * | 3/2005 | Doner | 705/7 |
| 7,006,796 | B1 | 2/2006 | Hofmann et al. | |
| 7,188,025 | B2 * | 3/2007 | Hudson, Jr. | 701/117 |
| 2003/0105561 | A1 | 6/2003 | Nickles et al. | |
| 2003/0183729 | A1 | 10/2003 | Root et al. | |
| 2003/0236598 | A1 * | 12/2003 | Villarreal Antelo et al. | 701/19 |
| 2004/0010432 | A1 | 1/2004 | Matheson et al. | |
| 2004/0034556 | A1 | 2/2004 | Matheson et al. | |
| 2004/0093196 | A1 | 5/2004 | Hawthorne | |
| 2004/0093245 | A1 | 5/2004 | Matheson et al. | |
| 2004/0267415 | A1 | 12/2004 | Lacote et al. | |
| 2005/0107890 | A1 | 5/2005 | Minkowitz et al. | |
| 2005/0192720 | A1 | 9/2005 | Christie et al. | |
| 2006/0074544 | A1 | 4/2006 | Morariu et al. | |

FOREIGN PATENT DOCUMENTS

| | | |
|---|---|---|
| CA | 2066739 | 2/1992 |
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

METHOD AND APPARATUS FOR CONGESTION MANAGEMENT

RELATED APPLICATIONS

This application is a continuation in part of application Ser. No. 10/785,059 filed Feb. 25, 2004, now abandoned claiming the benefit of U.S. Provisional Application No. 60/449,849 filed on Feb. 27, 2003.

This application is also one of the below listed applications being concurrently filed:

Application Ser. No. 11/342,856 entitled "Scheduler and Method for Managing Unpredictable Local Trains";

Application Ser. No. 11/342,855 entitled "Method And Apparatus For Optimizing Maintenance Of Right Of Way";

Application Ser. No. 11/342,853 entitled "Method and Apparatus for Coordinating Railway Line-Of-Road and Yard Planners";

Application Ser. No. 11/342,875 entitled "Method and Apparatus for Selectively Disabling Train Location Reports";

Application Ser. No. 11/342,854 entitled "Method and Apparatus for Automatic Selection of Train Activity Locations";

Application Ser. No. 11/342,857 entitled Method And Apparatus For Automatic Selection Of Alternative Routing Through Congested Areas Using Congestion Prediction Metrics"; and Application Ser. No. 11/342,816 entitled "Method and Apparatus for Estimating Train Location".

The disclosure of each of the above referenced applications including those concurrently filed herewith is hereby incorporated herein by reference.

BACKGROUND OF THE INVENTION

The present invention relates to the scheduling of movement of plural units through a complex movement defining system, and in the embodiment disclosed, to the scheduling of the movement of freight trains over a railroad system and specifically to congestion management.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced applications, and upon determining a schedule, a movement plan may be created using the very fine grain structure necessary to actually control the movement of the train. Such fine grain structure may include assignment of personnel by name, as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or may be provided to the locomotives so that it can be implemented by the engineer or automatically by switchable actuation on the locomotive.

The planning system is hierarchical in nature in which the problem is abstracted to a relatively high level for the initial optimization process, and then the resulting course solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

Currently, a dispatcher's view of the controlled railroad territory can be considered myopic. Dispatchers view and process information only within their own control territories and have little or no insight into the operation of adjoining territories, or the railroad network as a whole. Current dispatch systems simply implement controls as a result of the individual dispatcher's decisions on small portions of the railroad network and the dispatchers are expected to resolve conflicts between movements of objects on the track (e.g. trains, maintenance vehicles, survey vehicles, etc.) and the available track resource limitations (e.g. limited number of tracks, tracks out of service, consideration of safety of maintenance crews near active tracks) as they occur, with little advanced insight or warning.

Congestion inevitably occurs in the routing of trains and is a significant problem. Examples of congestion include track block, train ahead without authority to move, unidentified track occupancy, train needs additional motive power, train nearing the end of a plan that is truncated because of a planning exception, and train ahead in a safe place.

The routing of trains into a congested area tends to exacerbate the congestion and may result in deadlock. When a train is routed too far into congestion, options for resolving the congestion are reduced. For example, if a track is blocked for a mishap and trains are routed as closely as possible to the blockage, some of the routes to reach the mishap and to route trains around it are unavailable.

Because the delay in the movement of trains is subject to cost constraints including contract penalties, the tendency of dispatchers is to continue to push trains through an area as rapidly as possible, advancing their movement along the line of road whenever possible, and treating the resulting congestion as a track availability problem to be solved through the assignment of track resources to create alternative routes through the congested area. The movement planners used by dispatchers in adjacent territories are often completely independent of each other and uninformed as to the status of the tracks in adjacent territories. As a result, dispatchers in uncongested areas may continue to send trains into a congested area in the adjacent territory.

The present application relates to the maximizing of the throughput of trains in the overall system at the expense of the movement of trains over smaller sections of track. This typically results in the delay of trains outside an area of congestion in order to provide time to clear the congestion. One major advantage of such delay is that the alternative routes may be kept open thus facilitating the clearance of the congestion and the overall efficiency of the system.

It is accordingly an object of the present invention to reduce congestion and avoid deadlock by the management of the entry of trains into a congested area. In part, this is accomplished by the cessation of the automatic routing of trains once congestion is detected or anticipated. If possible, it is desirable to hold trains nearing the congested area (or area projected to become congested) in safe areas, i.e., areas where other trains may pass.

These and many other objects and advantages of the present invention will be readily apparent to one skilled in the art to which the invention pertains from a perusal of the claims, the appended drawings, and the following detailed description of the preferred embodiments.

DETAILED DESCRIPTION

Figure 1:
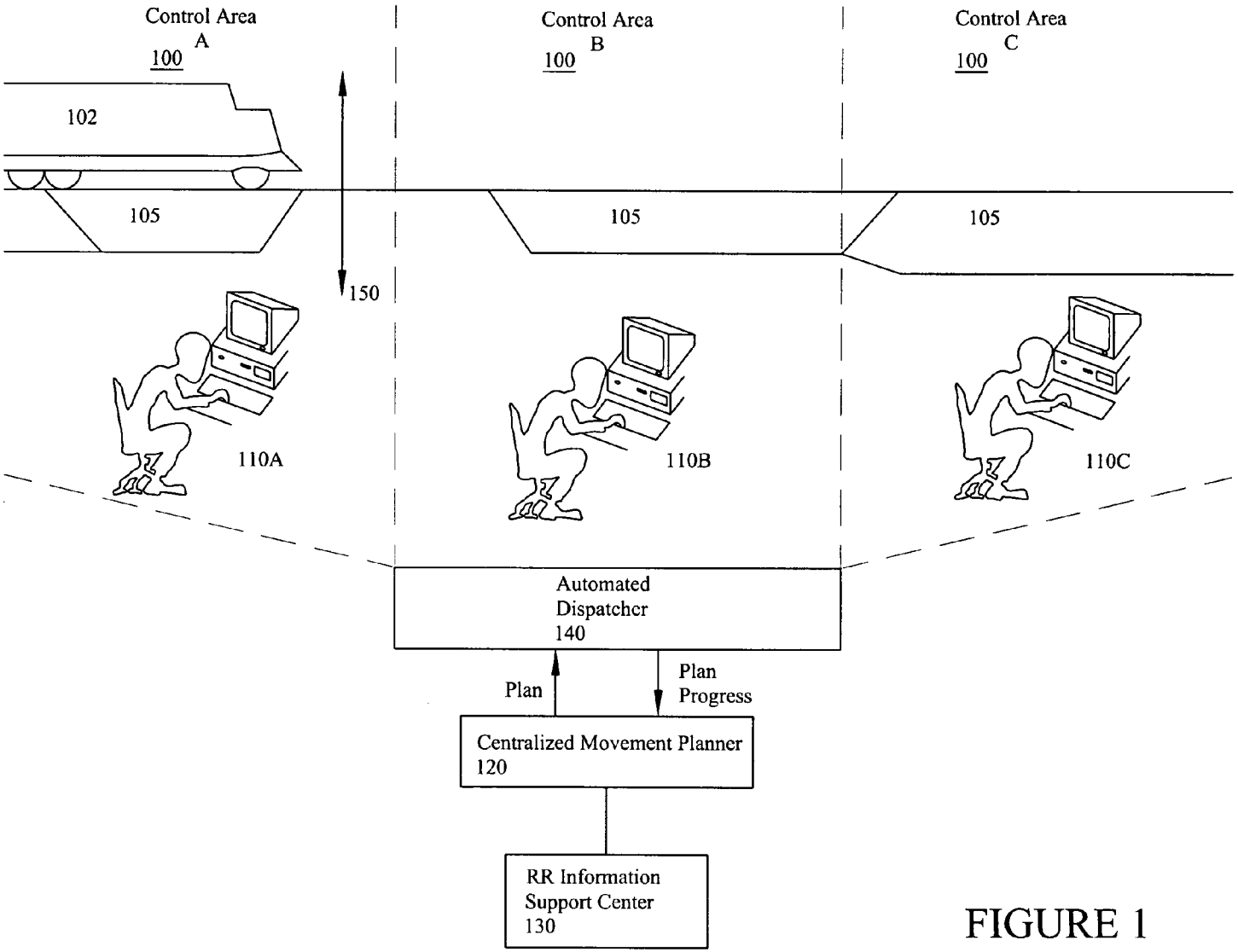
FIG. 1 is a simplified pictorial representation of one embodiment of the present invention for use with a rail network divided into control areas.

As illustrated in FIG. 1, the global rail network 105 can be divided into one or more control areas 100 (100A-100C), each of which has a dispatcher 110 (110A-110C) assigned to manage the movement of trains (102) through his respective control area 100. A centralized movement planner 120 provides a network based movement plan for the global rail network 105 based on input received from the railroad information support center 130. The railroad information support center 130 provides information related to the track resources and other information suitable to plan the use of the resources. Centralized movement planner 120 generates a movement plan for the resources in the track network 105 and provides the plan to the automated dispatcher 140. Movement planner 120 may also received updates on the execution of the movement plan from automated dispatcher 140 and can update the current movement plan. Automated dispatcher 140 provides each of the dispatchers 110 with the movement plan to manage the train resources in their respective control areas 110.

As described in the referenced applications, the automated dispatcher 140 can be implemented using computer usable medium having a computer readable code executed by special purpose or general purpose computers. The automated dispatcher 140 communicates with trains 102 on the network of track via a suitable communication link 150, such as a cellular telephone, satellite or wayside signaling.

The dispatcher issues and approves the issuance of movement authorities and track restrictions, schedule maintenance of way activities and communicates with train crews, yard managers and other railroad personnel consistent with an optimized operating plan for the railroad. While the dispatcher will rely on the movement planner to solve the complex problem of optimizing movement of trains, the dispatcher will be actively involved in entering the necessary data required to maintain an optimized plan and identify exceptions to the plan.

As disclosed in the referenced applications, enhanced planning is facilitated by automatically supplying the movement planner 120 with information from the railroad information support center 130 which associates train consist events (e.g., pickups, crew changes, engine destinations) with planned train activities that occupy track resources for the duration of a dwell time, so that maintenance of the traditional train sheet data (via electronic messaging and user data entry) is automatically reflected in the train trip specifications for use for movement planning.

From this information, and with the aid of suitable conventional traffic flow analysis algorithms desirably embedded in the movement planner 120, congestion in a particular geographic area can be identified and train movement can be rescheduled to achieve two results. First, trains in outlying areas which have not encountered congestion are rescheduled so that they do not exacerbate the congestion. In one embodiment this is accomplished by identifying safe spot to position each train in the outlying area. A safe spot is one in which a train can be met or passed to allow clearing out of the congested area. The second desired result is to clear the area of core congestion. In one embodiment, the trains involved in the congestion are selectively rescheduled so long as the movement of the train does not make the congestion worse.

Figure 2:
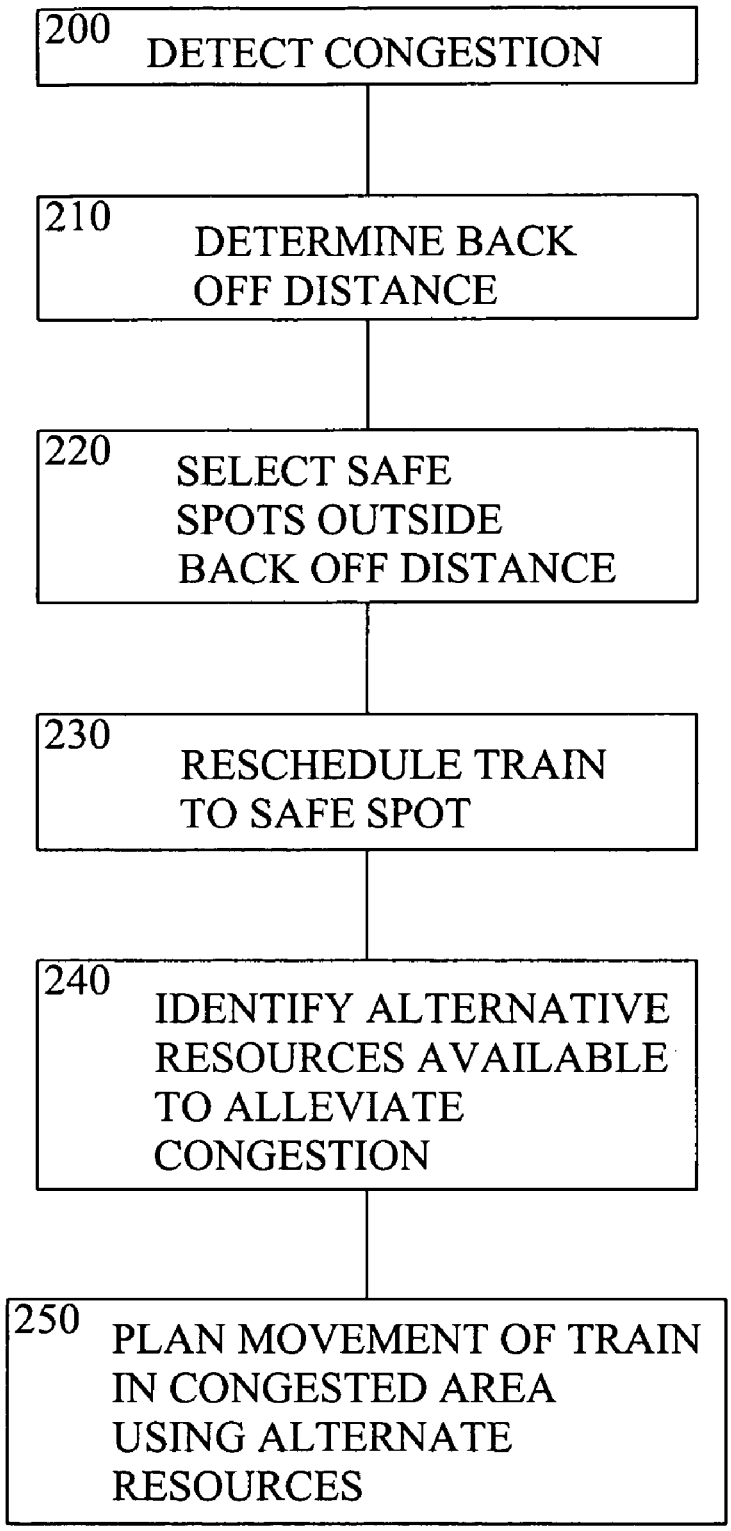
FIG. 2 is a simplified flow diagram of one embodiment of a congestion management method.

The ultimate goal of congestion management is to prevent deadlock. Once congestion is detected affirmative steps must be taken to prevent the congestion from getting worse. With respect to FIG. 2 the detection of the congestion can be accomplished using any convention traffic flow algorithms 200. Next a back-off distance is determined 210 for the track surrounding the congestion to prevent further trains from entering the back-off area. The back off area can be defined by a circle surrounding the congested area having a radius determined as a function of the train density in the congestion, train density in the outlying area, type and size of the congestion and track topography. For each train that was previously planned to enter the back-off area, the track topography is evaluated to select an advantageous spot to hold the train 220. These spots are typically know as safe spots and are chosen because they allow the passage of another train or equipment. For example, congestion may be caused by derailment of a train. Crucial to clearing this congestion is the arrival of apparatus for clearing the derailment. It is important that safe spots are selected such that a clear route along the track is available for the apparatus. Once the safe spots are identified, the approaching trains are rescheduled to their respective safe spots 230. For the trains in the congestion area, several alternatives are available: (a) the train can be left where it is, (b) the train can be moved forward along its planned route, or (c) the train can be moved forward along an alternate route. In one embodiment, resources not normally available to the movement planner can be identified and evaluated to determine if they can be utilized to alleviate the congestion 240. For example, industry tracks that are not normally available to the planner can be identified to move a congested train. Likewise, a siding normally used for a single train can be used by two trains simultaneously to alleviate the congestion. As another example, a section of track that is typically not chosen for a meet and pass can be temporarily made available to the planner for use in clearing the congestion. Thus, additional resources may be made available to the movement planner to assist alleviate the identified congestion. After additional resources have been identified, the trains in the congested area are rescheduled using one of the parameters above so long as the congestion is not made worse 250. Deadlocks may thus be prevented and the alternate routes may remain unblocked for use by the movement planner 120 in clearing the congestion. While the delay of trains in uncongested areas may be costly, this cost may pale in comparison to the savings achieved as a result of the improvement of traffic flow through the system as a whole.

The traffic flow algorithms used to manage congestion consider the track topography, location of trains, planned routes, time to traverse the planned routes and train constraints in planning the movement of trains in the outlying areas and in the congested areas. These methods can be implemented using computer usable medium having a computer readable code executed by special purpose or general purpose computers.

While preferred embodiments of the present invention have been described, it is understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of managing congestion in a railway system having a network of track and a plurality of trains scheduled to traverse the rail network comprising:

(a) detecting congestion along the rail network and identifying a first train involved in the congestion;

(b) identifying a back-off area surrounding the congestion defined as a function of one of the train density in the congestion, train density in the outlying area, type of the congestion, size of the congestion or track topography;

(c) selecting a safe spot outside the back-off area for a second train that was previously planned to enter the back-off area;

(d) planning the movement of the second train to the safe spot;

(e) identifying alternative resources available to alleviate congestion; and (f) planning the movement of the first train using the identified alternative resources.

2. The method of claim 1 wherein the back-off area is defined by a circle surrounding the congested area.

3. The method of claim 1 wherein the identified alternative resources includes a track section not normally available to a movement planner.

4. The method of claim 3, wherein the track not normally available to a movement planner includes a siding which is used by two trains simultaneously.

5. The method of claim 3 wherein the track not normally available to a movement planner includes industry tracks.

6. The method of claim 3 wherein the track not normally available to a movement planner includes a track that is not normally used for a meet and pass.

7. The method of claim 1 where the steps of (c) and (d) are performed for each train planned to enter the back-off area.

8. The method of claim 7 where the steps of (b) and (c) are performed for each train approaching the congestion.

9. A method of managing congestion in a railway system having a network of track and a plurality of trains scheduled to traverse the rail network comprising:

(a) detecting congestion along the rail network;

(b) selecting a train that is approaching the congestion;

(c) identifying a back-off area surrounding the congestion defined as a function of one of the train density in the congestion train density in the outlying area, type of the congestion, size of the congestion or track topography;

(d) selecting a safe spot outside the back-off area; and (e) rescheduling the selected train to delay the train at the selected safe spot;

wherein the safe spot is an area where other trains may pass along the rail network.

10. The method of claim 9 wherein the back-off area is defined by a circle surrounding the congested area.

11. A computer program product for use with a railway scheduling computer:

a computer usable medium having computer readable program code modules embodied in said medium for managing congestion in a railway system having a network of track and a plurality of trains scheduled to traverse the rail network;

computer readable first program module for causing a computer to detect congestion along the rail network and identifying a first train involved in the congestion;

computer readable second program module for causing a computer to identify a back-off area surrounding the congestion defined as a function of one of the train density in the congestion, train density in the outlying area, type of the congestion, size of the congestion or track topography;

computer readable third program module for causing a computer to select a safe spot outside the back-off area for a second train that was previously planned to enter the back-off area;

computer readable fourth program module for causing a computer to plan the movement of the second train to the safe spot;

computer readable fifth program module for causing a computer to identify alternative resources available to alleviate congestion; and computer readable sixth program module for causing a computer to plan the movement of the first train using the identified alternative resources.

* * * * *